US006367143B1

(12) United States Patent
Sugimura

(10) Patent No.: US 6,367,143 B1
(45) Date of Patent: Apr. 9, 2002

(54) COIL ELEMENT AND METHOD FOR MANUFACTURING THEREOF

(75) Inventor: Shiro Sugimura, Ishikawa (JP)

(73) Assignee: Smart Card Technologies Co. Ltd., Tokyo (JP)

( * ) Notice: Subject to any disclaimer, the term of this patent is extended or adjusted under 35 U.S.C. 154(b) by 0 days.

(21) Appl. No.: 09/263,990

(22) Filed: Mar. 5, 1999

(30) Foreign Application Priority Data

Mar. 10, 1998 (JP) ..... 10-058587

(51) Int. Cl.[7] ..... H01F 5/00

(52) U.S. Cl. ..... 29/602.1; 29/607; 336/200; 336/223

(58) Field of Search ..... 336/200, 223, 336/232; 29/602.1, 607

(56) References Cited

U.S. PATENT DOCUMENTS

| | | | | |
|---|---|---|---|---|
| 3,858,138 A | * 12/1974 | Gittleman et al. | ..... | 336/136 |
| 5,450,755 A | * 9/1995 | Senda | ..... | 336/200 |
| 5,461,353 A | * 10/1995 | Eberhardt | ..... | 333/246 |
| 5,576,680 A | * 11/1996 | Ling | ..... | 336/200 |
| 5,610,569 A | * 3/1997 | Hwang et al. | ..... | 336/200 |

FOREIGN PATENT DOCUMENTS

| | | | |
|---|---|---|---|
| EP | 0 777 293 A1 | 6/1973 | ..... H01Q/1/36 |
| EP | 0 515 821 A1 | 4/1992 | ..... H01F/17/02 |
| EP | 0 594 180 A3 | 10/1993 | ..... G01L/1/12 |

OTHER PUBLICATIONS

Ahn et al, a Fully Integrated Planar Toroidal Inductor with a Micromachined Nickel–Iron Magnetic Bar, IEEE transactions on components, packaging and manufacturing technology, Part a, vol. 17, No. 3, Sep,. 1994.*

Yamaguchi et al, Characteristics and Analysis of a Thin Film Inductor with Closed Mangetic Circuit Structure, IEEE Transactions on Magnetics, vol. 28, No 5, Sep. 1995.*

Senda et al, High Frequency Magnetic Properties of CoFe/SiO2 Multilayer Flim with the Inverse Magnetostrictive Effect, IEEE Transaction Mag 30, 1994.*

European Search Report for EP 99 30 1786, mailed Oct. 27, 1999. ( 3 pages).

* cited by examiner

*Primary Examiner*—Anh Mai
(74) *Attorney, Agent, or Firm*—Fitch, Even, Tabin & Flannery

(57) ABSTRACT

A coil element according to the present invention includes a plurality of first conductive materials formed on a base material at a predetermined pitch, an insulation material superposed on the first conductive materials, and a plurality of second conductive materials formed on the insulation material at a predetermined pitch, wherein the first conductive materials and the second conductive materials are alternately connected to each other while interposing the insulation material between the both to form a three-dimensional coil. By properly selecting a pitch, a width, or a length of the coil, it is possible to easily realize a desired high inductance vale even though a pattern area is small.

6 Claims, 6 Drawing Sheets

COIL ELEMENT AND METHOD FOR MANUFACTURING THEREOF

This application is based on Patent Application No. 58587/1998 filed on Mar. 10, 1998 in Japan, the content of which is incorporated hereinto by reference.

BACKGROUND OF THE INVENTION

1. Field of the Invention

The present invention relates to a coil element and a method for manufacturing thereof, particularly suitably used for an antenna incorporated in a small-sized communication device or a non-contact type smart IC card.

2. Description of the Prior Art

An antenna fitted to a working frequency band has been incorporated in a small-sized communication device or a non-contact type smart IC card such as a mobile telephone, a pager or a portable information-processing terminal equipment.

To realize a predetermined frequency characteristic, the conventional antenna may be formed on a printed circuit board by using a flat coil. In this regard, the coil is formed in a two-dimensional pattern, for example, of a spiral form or a zigzag form.

According to this prior art, since the coil is formed in a two-dimensional manner on the printed circuit board, it is difficult to realize a high inductance if a pattern size is minimized, resulting in a problem in that a working frequency band is liable to be limited.

SUMMARY OF THE INVENTION

An object of the present invention is to solve the above-mentioned drawbacks of the prior art by providing a three-dimensional coil element capable of realizing a high inductance even though a pattern size is small and a method for manufacturing thereof.

A first aspect of the present invention is a coil element comprising: a plurality of first conductive materials formed on a base material at a predetermined pitch; an insulation material formed on the base material to cover the first conductive materials except for opposite ends of the first conductive materials; and a plurality of second conductive materials formed on the insulation material at a predetermined pitch to be alternately conductive to the opposite ends of the first conductive materials; wherein the first conductive materials and the second conductive materials are alternately connected to each other while interposing the insulation material between the both, to form a three-dimensional coil.

According to the first aspect of the present invention, the three-dimensional coil is formed, wherein the first conductive materials are alternately connected to the second conductive materials on the base material while interposing the insulation material between the both. By properly adjusting the pitch, width, or length of the coil, it is possible to obtain a markedly dense winding of the coil in comparison with that obtained from a coil of a two-dimensional flat pattern, whereby an antenna is realized, has a high sensitivity which is excellent in a transmission distance and has a higher inductance even though a pattern size is smaller.

In the coil element of the first aspect of the present invention, when the insulation material forming a core of the coil is made of magnetic material and preferably multi-layered, it is possible to increase the coil inductance.

A connection terminal is preferably added to one end of the coil for facilitating the connection of the coil to an external electric circuit.

In order to mechanically protect the second conductive materials, to prevent the coil from being broken, or to avoid the second conductive materials from being oxidized, a protective material may be provided on the base material to cover the second conductive materials.

A plurality of coils may be superposed on the base material as coil layers. For example, a plurality of coils having different resonant frequencies may be superposed on each other in the same orientation to form an antenna element of a stacked type having a broad frequency band characteristic, or a plurality of coils may be superposed on each other in the different orientations to form a so-called polarized wave synthetic array type antenna element capable of transmitting and/or receiving both of horizontally and vertically polarized waves.

A second aspect of the present invention is a method for manufacturing a coil element comprising the steps of: printing a plurality of first conductive materials on a base material; providing an insulation material on the base material to cover the first conductive materials except for opposite ends of the first conductive materials; and printing a plurality of second conductive materials on the insulation material at a predetermined pitch to be alternately conductive to the opposite ends of the first conductive materials; wherein the first conductive materials and the second conductive materials are alternately connected to each other while interposing the insulation material between the both, to form a three-dimensional coil.

According to the second aspect of the present invention, it is possible to easily form a three-dimensional coil solely by a printing process even though the base material is a thin flexible film or the like.

A third aspect of the present invention is a method for manufacturing a coil element comprising the steps of: forming a plurality of first conductive materials on a base material at a predetermined pitch by etching a conductive layer preliminarily provided on the base material; providing an insulation material on the base material to cover the first conductive materials except for opposite ends of the first conductive materials; and printing a plurality of second conductive materials on the insulation material at a predetermined pitch to be alternately conductive to the opposite ends of the first conductive materials; wherein the first conductive materials and the second conductive materials are alternately connected to each other while interposing the insulation material between the both, to form a three-dimensional coil.

According to the third aspect of the present invention, since a printed circuit board may be used as the base material, it is possible to simultaneously form necessary leads and/or connection terminals together with the first conductive materials.

In the second and third aspects of the present invention, a step may be added for providing a protective material on the base material to cover the second conductive materials.

According to the present invention, since the coil is formed by printing or etching the first conductive materials on the base material and then sequentially superposing the insulation material and the second conductive materials thereon, it is possible to extremely easily manufacture the coil element.

The above and other objects, effects, features and advantages of the present invention will become more apparent from the following description of embodiments thereof taken in conjunction with the accompanying drawings.

DETAILED DESCRIPTION OF THE PREFERRED EMBODIMENT

Figure 1:
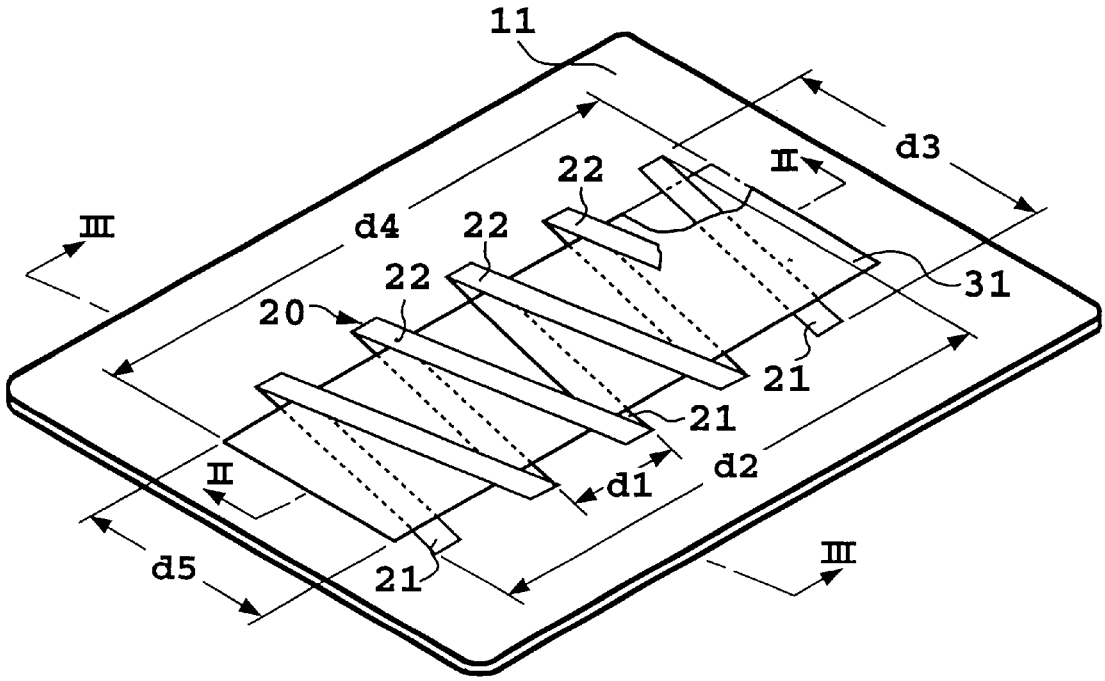
FIG. 1 is a perspective view illustrating an embodiment of a coil element according to the present invention.
Figure 2:
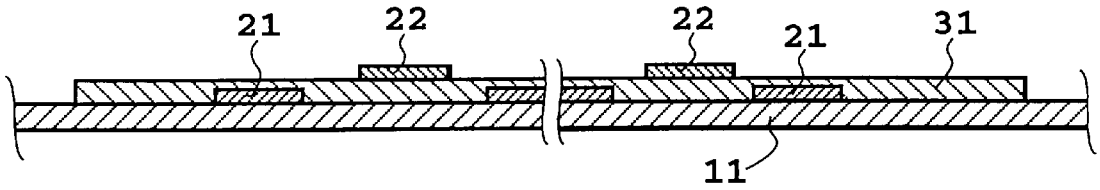
FIG. 2 is a broken sectional view taken along line II—II in FIG. 1.
Figure 3:
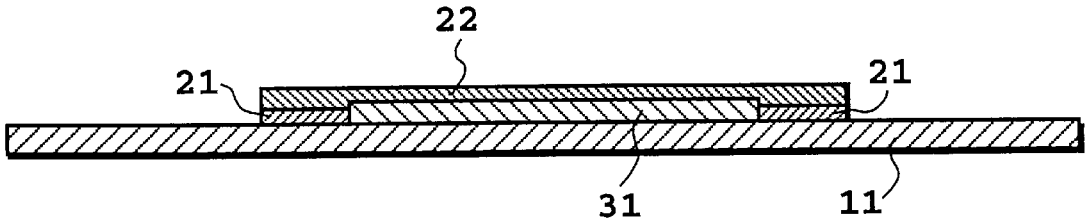
FIG. 3 is a sectional view taken along line III—III in FIG. 1.

A first embodiment of a coil element according to the present invention is illustrated in FIG. 1, and sectional structures thereof taken along lines II—II and III—III thereof are shown in FIGS. 2 and 3, respectively, wherein the coil element of this embodiment has a laminated structure comprising a base material 11 on which a plurality of first conductive materials 21, an insulation material 31, and a plurality of second conductive materials 22 are superposed in turn.

A flexible insulation film, insulation sheet, or insulation plate such as a printed circuit board or a flexible printed sheet is generally used as the above-mentioned base material 11 of a rectangular or non-rectangular shape.

The first conductive materials 21 are of a ribbon or wire form having the same length to each other. As shown in FIG. 1, the first conductive materials 21 are arranged in parallel to each other at a predetermined pitch d1 in an area of the base material 11 defined by a longitudinal range d2 and a lateral range d3. The conductive materials 21 are slanted to the longitudinal direction of the base material 11.

The insulation material 31 is formed in an area of the base material 11 defined by a longitudinal range d4 and a lateral range d5 shown in FIG. 1, to cross over the first conductive materials 21 in the arrangement direction of the latter. The length d4 of the insulation material 31 is selected to be larger than the longitudinal range d2 of the area of the base material 11 for the first conductive materials 21. While, the width d5 of the insulation material 31 is selected to be smaller than the lateral range d3 of the area of the base material 11 for the first conductive materials 21, whereby opposite ends of the respective first conductive material 21 project outside from opposite sides of the insulation material 31.

It is possible to adopt, as the insulation material 31, insulating resin, insulating ink, insulating paint, insulating adhesive sheet, insulating magnetic paint, insulating magnetic ink or others generally having a film thickness in a range from about 10 $\mu$m to about 15 $\mu$m. However, for the purpose of increasing inductance of the coil element, the insulation material 31 may be multi-layered to have a larger film thickness.

The second conductive materials 22 are of a ribbon or wire form having the same length to each other in a similar manner to the first conductive materials 21. That is, as shown in FIG. 1, the second conductive materials 22 are arranged in parallel to each other at a predetermined pitch in an area of the base material 11 defined by the longitudinal range d2 and the lateral range d3 to be superposed on the insulation material 31. The second conductive materials 22, however, are slanted to the longitudinal direction of the base material 11 in reverse to the first conductive materials 21 so that opposite ends of the former are superposed on those of the latter.

When a printed circuit board is used as the base material 11, it is possible to form the first conductive materials 21 by etching a conductive film preliminarily provided on the printed circuit board. In other cases, conductive paste, conductive ink, metal skin, adhesive metallic foil or others having a film thickness in a range from about 10 $\mu$m to about 25 $\mu$m may be adopted as the above-mentioned first and second conductive materials 21, 22.

Accordingly, the first and second conductive materials 21, 22 form a single continuous strip enveloping the insulation material 31, which defines, on the base material 11, a coil 20 of a three-dimensional structure having a length d2 and a width d3.

The coil element thus obtained may be compactly incorporated in a small-sized communication device, a smart IC card or the like, and used as a sensitive flat antenna, such as a helical antenna or a bar antenna, which resonates to a predetermined frequency. Or, it may be widely used as an inductance element or a transformer element for a general high frequency circuit.

Figure 4:
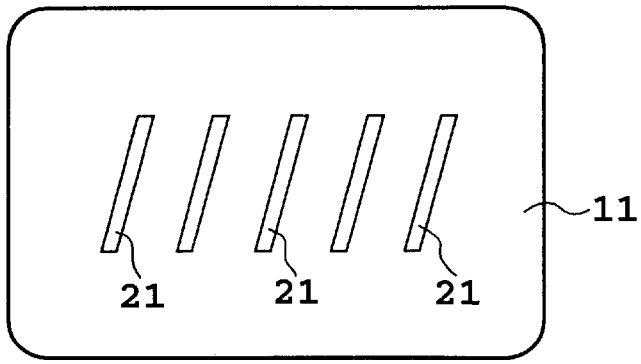
FIG. 4 illustrates, together with FIGS. 5 and 6, a process for manufacturing the coil element shown in FIG. 1, wherein a plurality of first conductive materials are formed.
Figure 5:
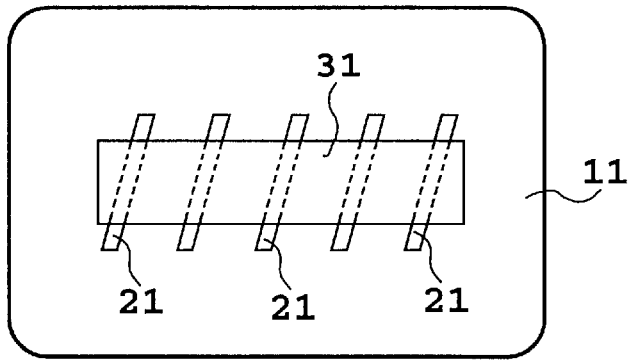
FIG. 5 illustrates, together with FIGS. 4 and 6, the process for manufacturing the coil element shown in FIG. 1, wherein an insulation material is formed.
Figure 6:
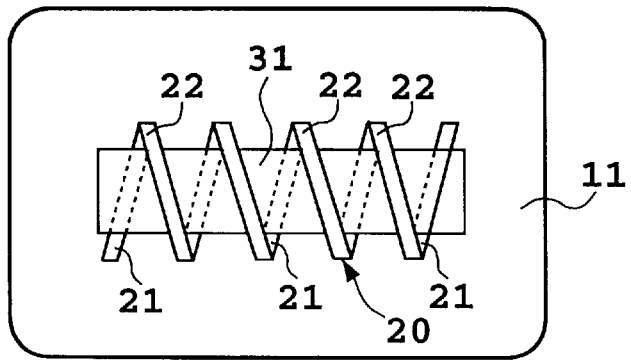
FIG. 6 illustrates, together with FIGS. 4 and 5, the process for manufacturing the coil element shown in FIG. 1, wherein second conductive materials are formed.

Such a coil element is manufactured in accordance with the steps shown in FIGS. 4 to 6. That is, the first conductive materials 21 are printed onto a surface of the base material 11 (see FIG. 4), then the insulation material 31 is printed onto the first conductive materials 21 while crossing over the latter (see FIG. 5), and further the second conductive materials 22 are printed onto the insulation material 31 while crossing over the latter to be conductive to the first conductive materials 21 (see FIG. 6), resulting in the coil 20. If the coil element is manufactured while using the printing technology as described above, it is possible to easily and quickly manufacture the coil element at a lower cost.

In this regard, it is also possible to form the above-mentioned first conductive materials 21, the insulation material 31 and the second conductive materials 22 by using a photo-etching technology or others. Particularly, when the first conductive materials 21 are formed by etching a conductive layer preliminarily provided on a printed circuit board, leads and/or connection terminals for the connection to other functional elements may be simultaneously formed. Also, if the insulation material 31 is made of magnetic material, it is possible to have a larger inductance in the coil 20 in comparison with that made of non-magnetic substrate.

It is also possible to add connection terminals to the above-mentioned coil 20.

Figure 7:
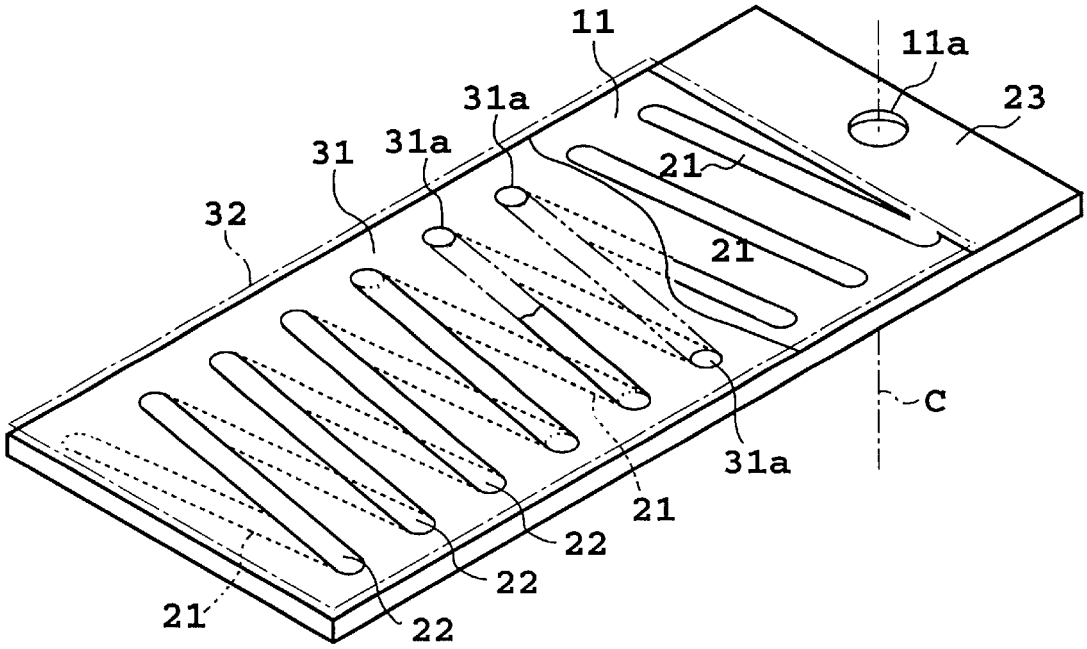
FIG. 7 is a perspective view illustrating another embodiment of a coil element according to the present invention.
Figure 8:
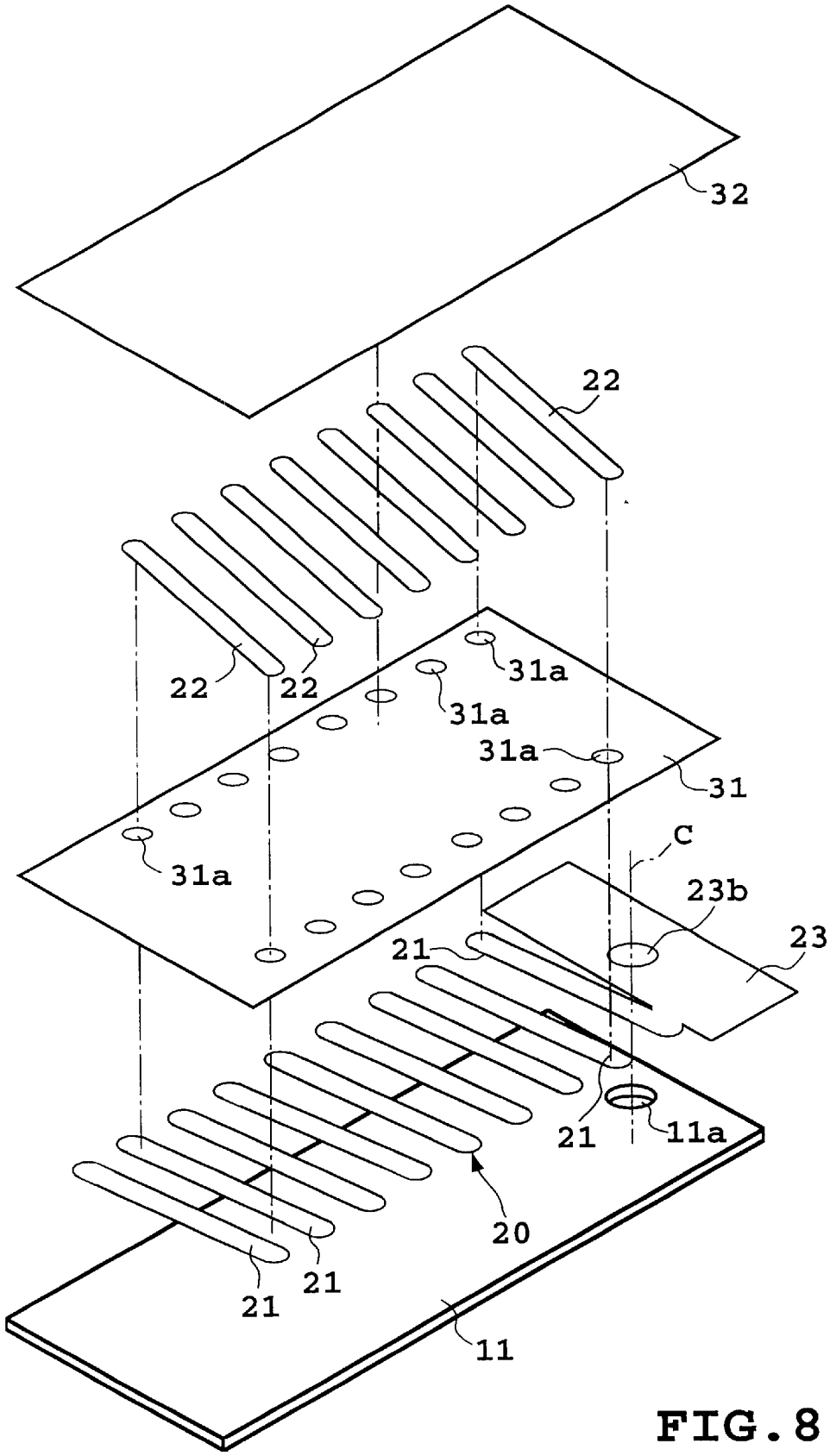
FIG. 8 is an exploded perspective view of the embodiment shown in FIG. 7.

Such another embodiment of a coil element according to the present invention is shown in FIG. 7, and an exploded view thereof is shown in FIG. 8. That is, a plurality of first conductive materials 21, an insulation material 31, a plurality of second conductive materials 22, and a protective material 32 are sequentially superposed on a base material 11 which is a printed circuit board.

The first conductive material 21 located at one longitudinal end of the base material 11 includes a connection terminal section 23 formed in integral therewith. The connection terminal section 23 has a connection aperture 23*b* corresponding to a through-hole 11*a* formed in the base material 11. A conductor wire or bump C connected to an external electronic circuit not illustrated is soldered to the connection terminal section 23 through the via-hole 11*a* and the connection aperture 23*b*.

Since the insulation material 31 in this embodiment is formed all over the surface of the base material 11 except for the connection terminal section 23, apertures 31*a* for the conduction between longitudinal opposite ends of the first and second conductive materials 21, 22 are provided in correspondence to the arrangement pitch thereof. Therefore, the longitudinal opposite ends of the second conductive material 22 extend through the apertures 31*a* and are conductive to the longitudinal opposite ends of the first conductive material 21. Accordingly, the coil 20 is obtained wherein the first conductive materials 21 and the second conductive materials are alternately connected to each other while interposing the insulation material 31 between the both.

The protective material 32 is formed all over the surface of the insulation material 31 while covering the second conductive materials 22 so that the second conductive materials 22 are not exposed outside. The protective material 32 may generally be formed of insulating resin, insulating ink, insulating paint or others having a film thickness in a range from about 10 $\mu$m to about 15 $\mu$m.

Although the coil 20 is formed as a single layer in the above embodiment, a plurality of such layers may be provided.

Figure 9:
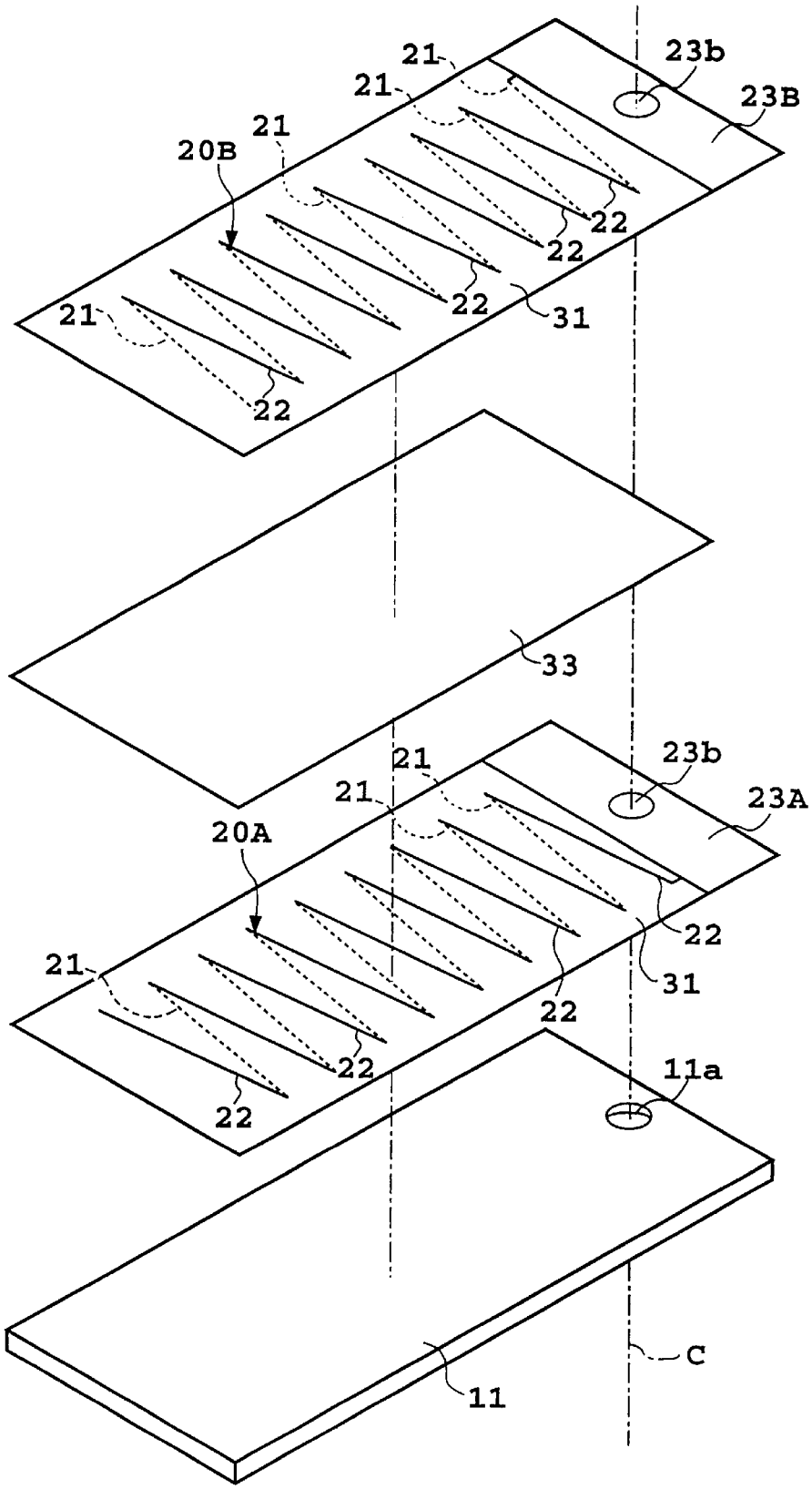
FIG. 9 is an exploded perspective view of further embodiment of a coil element according to the present invention.

Further embodiment according to the present invention of such a kind is shown in FIG. 9 wherein the same reference numerals are used for denoting materials having the same or similar functions to those of the preceding embodiments and the explanation thereof will be eliminated for the simplicity. That is, on a base material 11 is superposed a first coil 20A, on which a second coil 20B is superposed via an insulation material 33, to form a stack type antenna element. The insulation material 33 interposed between the first coil 20A and the second coil 20B is basically of the same substrates and dimension as those of the insulation materials in the coils 20A and 20B, and generally, insulating resin, insulating ink, insulating paint, insulating adhesive sheet, insulating magnetic paint, insulating magnetic ink or others may be adopted. However, to increase inductance of the coil element, the insulation material 31 may be multi-layered to have a larger film thickness. A connection terminal 23A of the first coil 20A and a connection terminal 23B of the second coil 20B are electrically conductive to each other.

The first and second coils 20A and 20B in this embodiment are of the same structure as described with reference to the embodiment shown in FIGS. 7 and 8. The longitudinal direction of the coil 20A and that of the second coil 20B are oriented in the same direction. Also, a pitch d1, a total length d2 and a width d3 (see FIG. 1) of each of the coils 20A and 20B are selected to be different from those of the other so that they resonate to different frequencies to realize a wide band frequency characteristic.

When the first coil 20A and the second coil 20B are oriented so that the longitudinal directions thereof are orthogonal to each other, it is possible to be responsive to polarized waves both in the horizontal and vertical directions.

The present invention has been described in detail with reference to preferred embodiments, and it will now be apparent from the foregoing to those skilled in the pattern that changes and modifications may be made without departing from the invention in its broader aspects, and it is the invention, therefore, in the appended claims to cover all such changes and modifications as fall within the true spirit of the invention.

What is claimed is:

1. A method for manufacturing a coil element comprising the steps of:

printing a plurality of first conductors on a base material;

printing an insulation material on said base material to cover said first conductors except for opposite ends of said first conductors; and printing a plurality of second conductors on said insulation material at a predetermined pitch to be alternately conductive to the opposite ends of said first conductors;

wherein said first conductors and said second conductors are alternately connected to each other while interposing said insulation material between the both, to form a three-dimensional coil.

2. A method for manufacturing a coil element as claimed in claim 1, further comprising a step of printing a protective material on said base material to cover said second conductors.

3. A method for manufacturing a coil element as claimed in claim 2, wherein said protective material is formed of insulating material.

4. A method for manufacturing a coil element as claimed in claim 1, wherein said base material is a printed circuit board.

5. A method for manufacturing a coil element as claimed in claim 1 wherein the step of printing a plurality of first conductors comprises printing conductive ink to form the first conductors and the steps of printing a plurality of second conductors comprises printing conductive ink to form the second conductors.

6. A method for manufacturing a coil element as claimed in claim 1 wherein the step of printing a plurality of first conductors comprises printing conductive paste to form the first conductors and the step of printing a plurality of second conductors comprises printing conductive paste to form the second conductors.

* * * * *